US008079694B2

(12) United States Patent
Steed et al.

(10) Patent No.: US 8,079,694 B2
(45) Date of Patent: Dec. 20, 2011

(54) CLEAR FLUID PATTERNING ON PAPER MEDIA

(75) Inventors: Mike Steed, Corvallis, OR (US); Lluis Abello, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 596 days.

(21) Appl. No.: 12/270,467

(22) Filed: Nov. 13, 2008

(65) Prior Publication Data

US 2010/0118066 A1 May 13, 2010

(51) Int. Cl.
*B41J 2/17* (2006.01)
*B41J 2/015* (2006.01)

(52) U.S. Cl. ..... 347/98; 347/20; 347/21; 347/95; 347/101

(58) Field of Classification Search ..... 347/21, 347/98

See application file for complete search history.

(56) References Cited

U.S. PATENT DOCUMENTS

| | | | | |
|---|---|---|---|---|
| 5,635,969 | A * | 6/1997 | Allen | 347/96 |
| 5,764,263 | A | 6/1998 | Lin | |
| 6,084,620 | A * | 7/2000 | Morikawa et al. | 347/96 |
| 6,428,143 | B2 * | 8/2002 | Irihara et al. | 347/43 |
| 6,454,383 | B2 | 9/2002 | Lund et al. | |
| 6,533,382 | B1 * | 3/2003 | Tomida et al. | 347/15 |
| 7,063,416 | B2 | 6/2006 | Laaspere et al. | |
| 2006/0176331 | A1 * | 8/2006 | Ishikawa et al. | 347/16 |
| 2008/0122890 | A1 | 5/2008 | Yorimoto | |

FOREIGN PATENT DOCUMENTS

| | | |
|---|---|---|
| GB | 2353761 | 7/2001 |
| JP | 2008-229981 | * 10/2008 |

OTHER PUBLICATIONS

Machine Translation of the detailed description from JP2008-229981 (published Oct. 2008).*

* cited by examiner

*Primary Examiner* — Ryan Lepisto
(74) *Attorney, Agent, or Firm* — Scott Gallert

(57) ABSTRACT

Methods and means for imaging on paper media are provided. A data file of an image to be printed is analyzed. A pattern for a clear fluid is determined according to the analysis. The pattern of clear fluid is applied to a paper media traveling in a particular direction, wherein the pattern is generally elongated along the direction of travel. The pattern of clear fluid is defined by a maximum width that is generally equal to the maximum width of the image to be formed. One or more colored inks are applied such that the image is formed and is supported by the paper media. The paper media exhibits reduced cockle as a result of the pattern of clear fluid.

7 Claims, 3 Drawing Sheets

CLEAR FLUID PATTERNING ON PAPER MEDIA

BACKGROUND

One known area of printing involves the jetting of ink onto paper media. Water content within such inks causes paper to dimple or form sinusoidal-like contours due to the swelling of paper. These contours or "cockle" include peaks and valleys such that the peaks may contact subsequent printheads or other mechanisms during the printing process. Contact can result in smearing, streaking or other damage to the images formed on the paper media. Additionally, the cockle formed in the paper may persist, even after the imaging has fully dried.

Paper that has cockled is not compatible with sharp bends around rollers, tightly wound rolls, or other aspects of some mechanized printing processes. As a result, cockled paper sometimes exhibits permanent creases or wrinkles due to process steps performed subsequent to imaging by the printheads.

Accordingly, the embodiments described hereinafter were developed in light of these and other drawbacks associated with the cockling of paper due to ink imaging.

BRIEF DESCRIPTION OF THE DRAWINGS

The present embodiments will now be described, by way of example, with reference to the accompanying drawings, in which.

DETAILED DESCRIPTION

Introduction

Methods and means for imaging on paper media are provided. In one embodiment, a data file of an image is analyzed prior to being printed (i.e., formed in ink on paper media). A pattern for a clear fluid is determined according to the analysis. The pattern of clear fluid is applied to a paper media traveling in a particular direction, wherein the pattern is generally elongated along the direction of travel. One or more colored inks are applied such that the image is formed and is supported by the paper media. In some embodiments, the one or more colored inks are applied over a portion of the pattern of clear fluid. The paper media thus processed and imaged exhibits substantially reduced cockle as compared to known techniques.

In one embodiment, a method is provided that includes transporting a paper media in a direction of travel. The method also includes applying a clear fluid to the paper media so as to define a pattern. The method further includes applying one or more colored inks so as to form an image. The pattern at least contacts the image and extends away there from.

Additionally, the pattern is defined by a maximum width that is about equal to that of the image.

In another embodiment, one or more computer-readable storage media include a program code. The program code is configured to cause one or more processors to control application of a clear fluid in a pattern on a paper media. The pattern corresponds to an image to be formed. The program code is further configured to cause the one or more processors to control application of one or more colored inks so as to form the image supported by the paper media. The pattern is elongated along a direction of travel of the paper media and extends away from the image in at least one direction. Also, the pattern is defined by a maximum width that is about equal to a width of the image.

In yet another embodiment, a controller is configured to control application of a clear fluid in a pattern on a paper media. The pattern corresponds to an image to be formed. The controller is further configured to control application of one or more colored inks such that the image is formed and supported by the paper media. The pattern extends away from the image along a direction of travel of the paper media. Additionally, the pattern has a maximum width about equal to that of the image.

First Illustrative Embodiment

Figure 1:
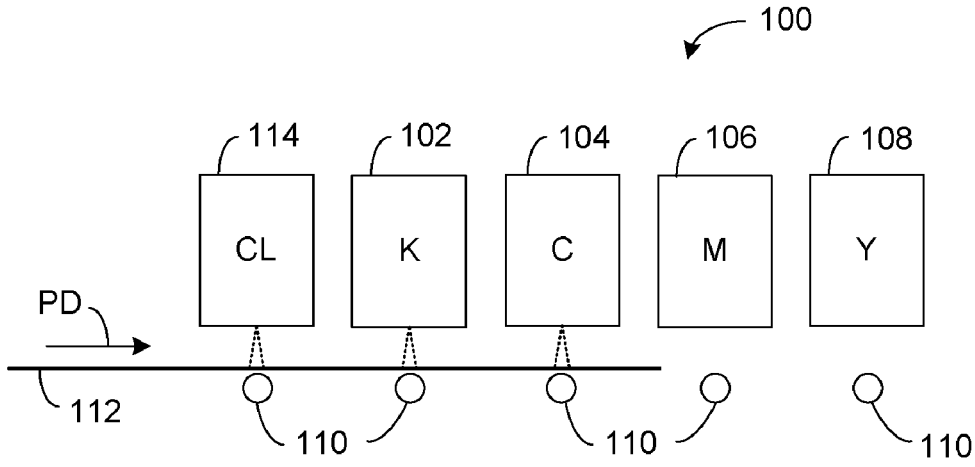
FIG. 1 depicts a schematic view of a printing system according to one embodiment.

FIG. 1 depicts a printing system 100 according to one embodiment. The system 100 includes a plurality of printheads 102, 104, 106 and 108. Each of the printheads 102-108 is configured to apply a corresponding color of ink (i.e., imaging media) to a receiving media. In one embodiment, each of the printheads is defined by a thermal inkjet (TIJ) printing assembly. Other suitable configurations and/or numbers of printheads can also be used. As depicted, the printheads 102, 104, 106 and 108 are associated with black (K), cyan (C), magenta (M) and yellow (Y) inks, respectively. Other sequences, fewer, greater and/or different ink colors, different means for applying ink, etc., can also be used.

The system 100 also includes a plurality of rollers 110 configured to guidingly support a sheet of paper media 112 into operative proximity (i.e., printing range or zone) with the printheads 102-108. In turn, the paper media 112 is propelled (by way of the rollers 110 and/or other means, not shown) past the printheads 102-108 in the direction indicated by the arrow "PD". In another embodiment (not shown), the rollers 110 are omitted and other means of supporting and/or propelling the paper media are used.

The system 100 also includes a printhead 114 configured to apply a clear fluid such as, for non-limiting example, a bonding agent that is selected to serve as an interface between the paper 112 and the ink(s) applied by the printheads 102-108. Such a clear bonding agent is available from Hewlett-Packard Company. The printhead 114 is located ahead of the printheads 102-108 with respect to the direction of travel PD of the paper media 112. That is, the paper 112 arrives within operative proximity to the printhead 114 before arriving within printing range of the printheads 102-108. It is to be understood that the system 100 depicts just a portion of a printing apparatus and that other mechanisms and/or processing can be applied which are not germane to the present teachings.

During typical operation, the printhead 114 applies a clear bonding agent (or other suitable clear fluid) to the paper 112 in accordance with the imaging to be formed by the ink printheads 102-108. Thereafter, the various colors of ink are selectively applied adjacent to and/or over portions of the pattern or patterns of clear fluid by the printheads 102-108 so as to form imaging (e.g., text, figures, indicia, photographs, etc.) on the passing paper media 112. The respective printheads 102-108 and 114 are understood to operate by way of a corresponding control system or device, not shown in FIG. 1. Further elaboration is with respect to such a control system according to the present teachings is provided hereinafter.

According to the present teachings, the printhead 114 applies a clear bonding agent (or other suitable clear fluid) to the paper 112 in a pattern ahead of and behind, and possibly beneath, the imaging formed by the color ink printheads 102-108. That is, the clear fluid (e.g., bonding agent, water, etc.) is applied so as to define leading and trailing regions (with respect to the colored ink) in any suitable pattern that is generally elongated along the direction of travel PD of paper 112. Non-limiting examples of such clear fluid patterning are described hereinafter with respect to FIGS. 3-5. In any case, the system 100 is configured and controlled so as to pattern those portions of the paper 112 with a clear fluid in such a way as to substantially reduce or eliminate cockle.

Second Illustrative Embodiment

Figure 2:
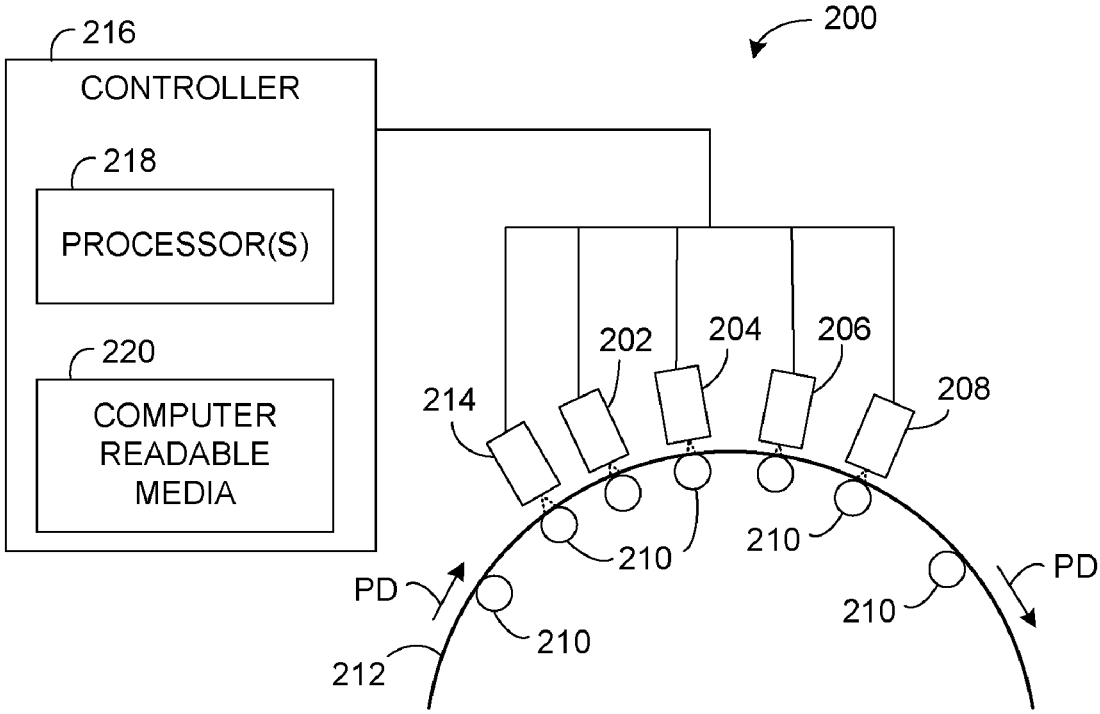
FIG. 2 depicts a schematic view of a printing system according to another embodiment.

FIG. 2 depicts a printing system 200 according to one embodiment. The system 200 includes a plurality of printheads 202, 204, 206 and 208. Each of the printheads 202-208 is configured to apply a corresponding color of ink (i.e., imaging media). According to one embodiment, each of the printheads 202-208 is defined by a thermal inkjet (TIJ) printhead. Other printhead types can also be used. In any case, the printheads 202-208 are configured to selectively emit ink of respective colors so as to form images (e.g., text, figures, photographs, etc.) onto paper media 212.

The system 200 also includes a plurality of rollers 210 configured to guide and support a long web (or ribbon) of paper media 212 along a pathway that is arcuate (i.e., non-planar) while passing within operative proximity (i.e., printing range) of the printheads 202-208. In turn, the paper media 212 is understood to be drawn from a supply roll (not shown), routed through the printing system 200 and any other aspects (not shown) thereof, and collected in rolled form on take-up roll (not shown). In another embodiment, the paper media is cut into discrete sheets and/or folded and there is no take-up roll, as such. In any case, the system 200 can also be referred to as a web printing system.

The system 200 also includes a printhead 214 configured to emit or jet a clear fluid such as, for non-limiting example, a bonding agent upon the paper media 212 prior to its arrival within printing range of the printheads 202-208. The printhead 214 is selectively controlled so as to apply a pattern or patterns of clear bonding agent (or other fluid) to the paper 212 in accordance with the imaging to be formed by the printheads 202-208.

The system 200 further includes a controller 216 having one or more processors 218. The processor(s) 218 operate(s) in accordance with program code stored on computer readable media 220. Non-limiting examples of computer readable media 220 include magnetic storage media, optical storage media, solid-state random access memory (RAM), read-only memory, (ROM), and non-volatile solid-state storage media. Other suitable forms of computer readable media 220 can also be used. It is to be understood that the system 200 depicts just a portion of a web printing apparatus and that other mechanisms and/or processing can be applied which are not germane to the present teachings.

Under typical operation, the controller 216 controls operations of the printheads 202-208 and 214 according to the program code stored on the computer readable media 220. In particular, the controller 216 controls the operation of the printhead 214 so as to selectively form patterns of a clear bonding agent (or water or other fluid) on the paper media 212. The controller 216 further controls operation of the color ink printheads 202-208 such that images are formed on the pattern or patterns of clear bonding agent and are thus bound to the paper media 212. The clear bonding agent is patterned on the paper 212 so that leading and trailing regions are defined extending away from the ink imaging and elongated along the direction of travel indicated by arrows PD. The clear bonding agent is further patterned such that a maximum width thereof is about equal to (i.e., does not significantly exceed) the maximum width of the image or images formed in colored ink(s).

Third Illustrative Embodiment

Figure 3:
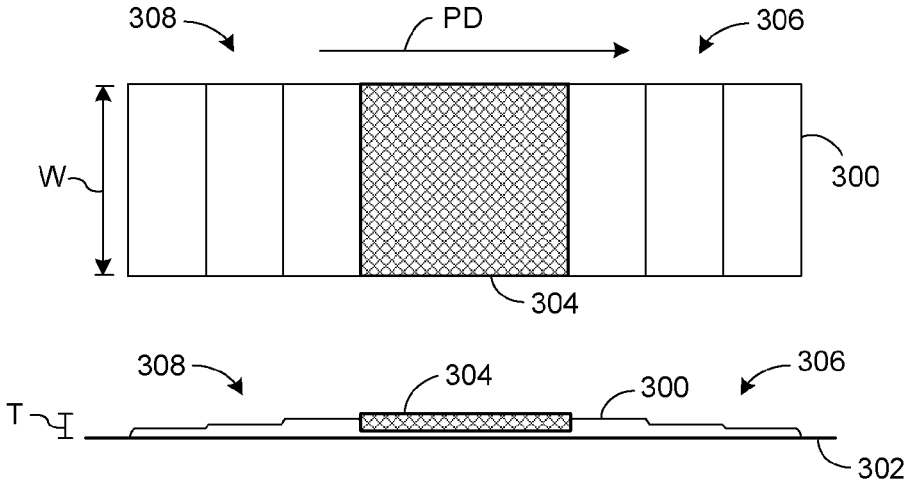
FIG. 3 depicts a pattern of clear fluid according to one embodiment.

FIG. 3 depicts a plan view and a side elevation view of an illustrative and non-limiting pattern 300 of clear fluid in accordance with the present teachings. The pattern 300 is applied to and supported by a paper media 302. The paper media 302 is understood to be in motion in a direction PD at the time the pattern 300 is being applied. An area of black ink 304, representing an illustrative and non-limiting image of a filled-in square, is applied over (i.e., onto) a central portion of the clear fluid pattern 300. The black ink 304 (or any other colored ink) soaks (i.e., seeps, or encroaches) at least partway into the pattern 300. In some instances, the colored ink can seep completely through the pattern of clear fluid and into contact with the underlying paper media.

The pattern 300 includes a leading edge portion 306 and a trailing edge portion 308. The pattern 300 is characterized by a substantially constant width W. It is noted that the maximum width W of the pattern 300 is about equal to the width of the black ink 304. The pattern 300 can optionally have a maximum width W that slightly exceeds the width of the black ink 304 so as to ensure a complete foundation on the paper media 302 beneath the black ink 304. In any case, the pattern 300 has a relatively simple, rectangular width profile when considered from end-to-end.

The pattern 300 is further characterized by a progressive, generally step-wise decrease in applied quantity (or application density), which is depicted as thickness T in the interest of clarity of understanding. The applied quantity of the pattern 300 decreases in opposite directions extending away from the applied ink 304 and along the direction of travel PD. Thus, the pattern 300 has a particular application profile when considered from end-to-end. As depicted, the application profile (i.e., thickness) of FIG. 3 is exaggerated in the interest of illustration and understanding. The pattern 300 is elongated along the direction of travel PD. The pattern 300 helps to substantially reduce cockle of the paper media 302.

Fourth Illustrative Embodiment

Figure 4:
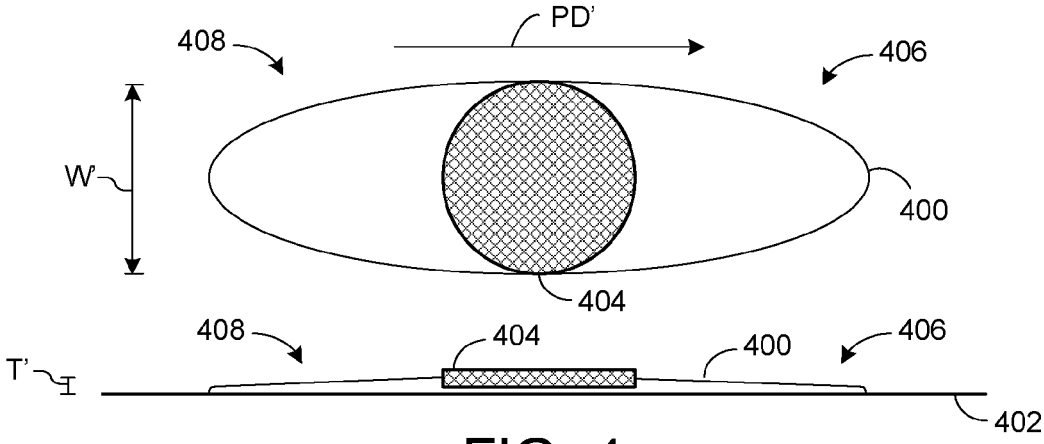
FIG. 4 depicts a pattern of clear fluid according to another embodiment.

FIG. 4 depicts a plan view and a side elevation view of another illustrative and non-limiting pattern 400 of clear fluid in accordance with the present teachings. The pattern 400 is applied to and supported by a paper media 402. The paper media 402 is understood to be in motion in a direction PD' at the time the pattern 400 is applied. An area of black ink 404, representing an illustrative and non-limiting image of a filled-in circle (i.e., a disk), is applied over (i.e., onto) a central portion of the clear fluid pattern 400.

The pattern 400 includes a leading edge portion 406 and a trailing edge portion 408. The pattern 400 is characterized by a width profile that is generally elliptical when considered from end-to-end. It is noted that the maximum width W' of the pattern 400 is substantially equal to (i.e., is not appreciably greater than) the maximum width of the black ink 404.

The pattern 400 is also characterized by a uniform application profile (thickness T') in the central portion directly underlying the black ink 404. The pattern 300 is further characterized by a progressive, generally linear decrease in applied quantity extending in opposite directions away from the applied ink 404 and along the direction of travel PD'. The pattern 400 therefore exhibits a particular application profile (i.e., thickness T') when considered from end-to-end. The pattern 400 is elongated along the direction of travel PD'. The pattern 400 is configured to substantially reduce cockle of the paper media 402.

Fifth Illustrative Embodiment

Figure 5:
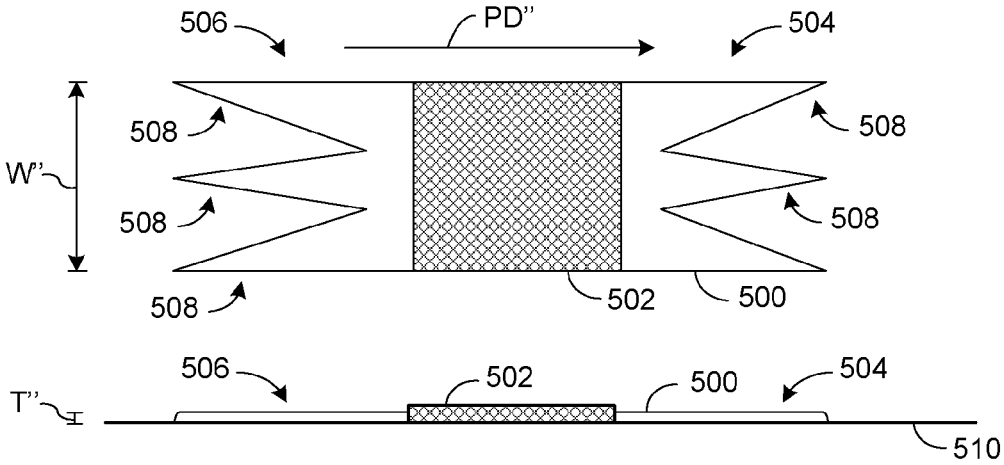
FIG. 5 depicts a pattern of clear fluid according to yet another embodiment.

FIG. 5 depicts a plan view of still another illustrative and non-limiting pattern 500 of clear fluid in accordance with the present teachings. The pattern 500 is applied to and supported by a paper media (not shown). The paper media is understood to be in motion in a direction PD" at the time the pattern 500 is applied. An area of black ink 502, representing an illustrative and non-limiting image of a filled-in square, is applied directly onto paper media 510. Thus, none of the pattern 500 of clear fluid (i.e., water) underlies the black ink 502. Rather, the pattern 500 is applied so as to define only leading and trailing areas about the black ink 502.

The pattern 500 includes a leading edge portion 504 and a trailing edge portion 506. The pattern 500 is characterized by an overall, maximum width W'. It is noted that the maximum width W' is about equal to the width of the black ink 502. The pattern 500 is also characterized by a plurality of triangular peninsulas or pennant-like extensions 508 that individually taper away from the area of black ink 502. As such, the pattern 500 has a relatively complex width profile as compared to those of patterns 300 and 400 described above.

The pattern 500 is further characterized by a uniform application quantity (or thickness T") throughout. Thus, the pattern 500 has a relatively simple application profile as compared to those of patterns 300 and 400 described above. The pattern 500 is elongated along the direction of travel PD".

The patterns 300, 400 and 500 are illustrative of any number of suitable patterns of clear fluid (e.g., bonding agent, water, etc.) applied to a paper media prior to the application of one or more overlying colored inks. Other suitable patterns can also be used in accordance with the image to be formed in colored ink. Simple image shapes—namely, solid squares and a disk—are depicted in FIGS. 3-5 in the interest of clarity and understanding. However, it is to be understood that more complex image shapes (e.g., letters, numbers, symbols, line graphics, photographic content, etc.) can be suitably accommodated by way of respective clear fluid patterns configured to reduce cockle of the supporting paper media.

In any case, patterns according to the present teachings are generally elongated in the direction of motion of the paper media during the application process. Additionally, such patterns define leading and trailing edges (or regions) that extend away from the colored ink or inks. Patterns according to the present teachings are further defined by respective width and application profiles.

Illustrative Processes

Figure 6:
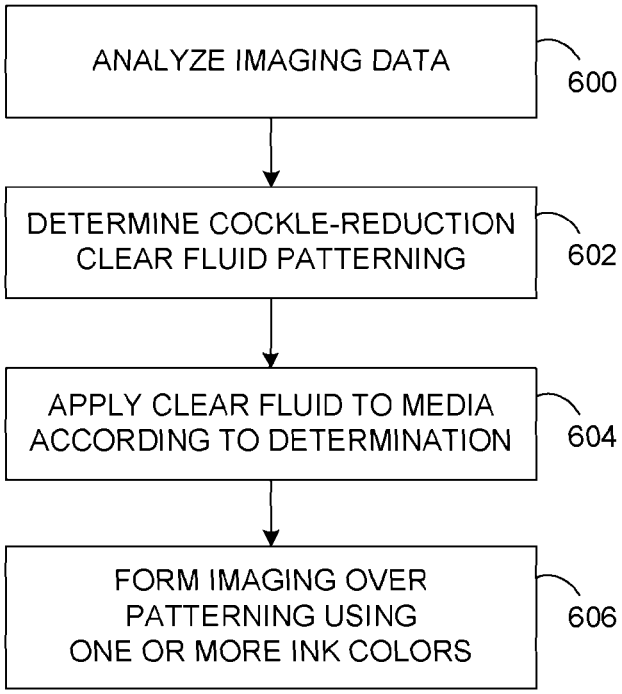
FIG. 6 depicts a flow diagram of a method according to one embodiment.

FIG. 6 is a flowchart depicting a method in accordance with one embodiment. The flowchart of FIG. 6 depicts particular method aspects and order of execution. However, it is to be understood that other methods including and/or omitting certain details, and/or proceeding in other orders of execution, can also be used without departing from the scope of the present teachings. Therefore, the method of FIG. 6 is illustrative and non-limiting in nature.

At 600, data defining an image to be printed in ink media is analyzed by automated means (e.g., controller 216, etc.). The image can include any of text, symbols, indicia, photographic imaging, etc. In any case, the data defines imaging to be formed over paper media using one or more colors of liquid ink.

At 602, one or more patterns of clear fluid are determined in accordance with the analysis at 600 above. The pattern(s) are determined so as to reduce cockle of the paper media upon which the image is to be formed. The respective patterns can be similar or dissimilar in characteristics such as, for non-limiting example, application profile, width profile, etc.

At 604, a suitable clear fluid, such as a bonding agent, is applied to a moving paper media such that the pattern or patterns determined at 602 above are formed.

At 606, ink printing is performed in one or more colors adjacent to the pattern or patterns formed at 604 above. None, some or all of the colored ink(s) may overlie the pattern of clear fluid. In this way, the image represented by the data is formed over and supported by the paper media. In turn, the clear fluid patterning serves to substantially reduce subsequent cockling of the paper media.

Figure 7:
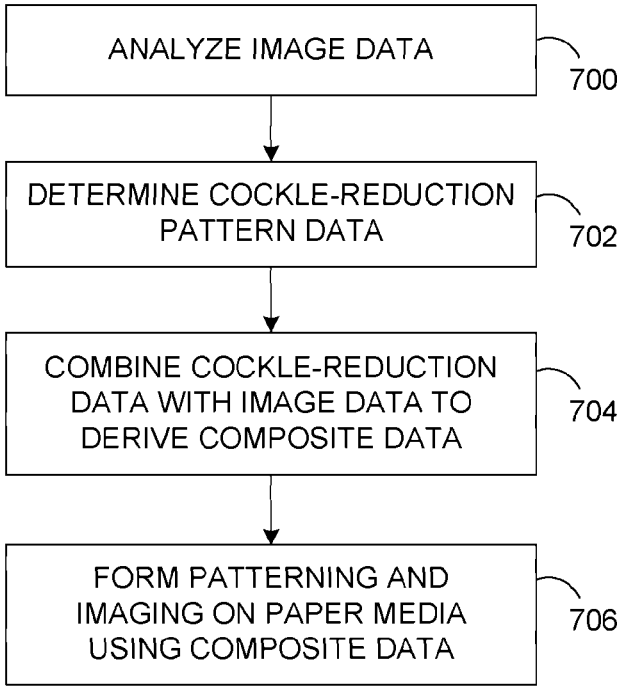
FIG. 7 depicts a flow diagram of a method according to another embodiment.

FIG. 7 is a flowchart depicting a method in accordance with another embodiment. The flowchart of FIG. 7 depicts particular method aspects and order of execution. However, it is to be understood that other methods including and/or omitting certain details, and/or proceeding in other orders of execution, can also be used without departing from the scope of the present teachings. Therefore, the method of FIG. 7 is illustrative and non-limiting in nature.

At 700, an image to be printed is analyzed by automated means (e.g., controller 216, etc.). Typically, digital data representing the image is under scrutiny during the analysis. The image can include any of text, symbols, indicia, photographic imaging, etc. In any case, the imaging is to be supported by paper media using one or more colors of liquid ink.

At 702, patterning of clear fluid is determined in accordance with the image analysis at 700 above. The determined patterning is such so as to reduce cockle of paper media upon which the image is to be formed. The respective patterns can be similar or dissimilar in characteristics such as, for non-limiting example, application profile, width profile, etc. In any event, portions of the patterning are determined so as to extend outward and away from those areas to be imaged in colored ink. The determined patterning is represented as digital data in a format compatible with the data representing the image.

At 704, the image data and the patterning data are combined so as to derive a composite data file representing the image and the underlying, cockle-reduction patterning.

At 706, the composite data file derived at 704 above is used to control the application of the clear fluid patterning and the one or more colored inks to a moving paper media by way of corresponding printheads. In this way, the image is formed over and supported by the paper media, while the clear fluid (e.g., bonding agent) patterning serves to reduce paper cockle.

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled.

It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. A method, comprising:

determining a pattern in accordance with an image to be printed, the pattern configured to reduce cockling of a paper media;

transporting the paper media in a direction of travel;

applying a clear fluid to the paper media so as to define the pattern; and applying one or more colored inks so as to form the image, the pattern least contacting the image and extending away there from, the pattern defined by a maximum width about equal to that of the image, the pattern being elongated in the direction of travel of the paper media, the pattern having a non-uniform thickness profile decreasing in thickness in at least one direction extending away from the image.

2. The method according to claim 1, the clear fluid not underlying any of the one or more colored inks.

3. The method according to claim 1, the pattern decreasing in width in at least one direction extending away from the image.

4. The method according to claim 1, the paper media being transported along a non-planar pathway during at least the applying of the clear fluid or the applying of the one or more colored inks so as to form the image.

5. A method, comprising:

determining a pattern in accordance with an image to be printed, the pattern configured to reduce cockling of a paper media;

transporting the paper media in a direction of travel;

applying a clear fluid to the paper media so as to define the pattern; and applying one or more colored inks so as to form the image, the pattern at least contacting the image and extending away there from, the pattern defined by a maximum width about equal to that of the image, the pattern being elongated in the direction of travel of the paper media, the pattern decreasing in width in at least one direction extending away from the image.

6. The method according to claim 5, the paper media being transported along a non-planar pathway during at least the applying of the clear fluid or the applying of the one or more colored inks so as to form the image.

7. The method according to claim 5, the clear fluid not underlying any of the one or more colored inks.

* * * * *

UNITED STATES PATENT AND TRADEMARK OFFICE

CERTIFICATE OF CORRECTION

PATENT NO. : 8,079,694 B2
APPLICATION NO. : 12/270467
DATED : December 20, 2011
INVENTOR(S) : Mike Steed et al.

It is certified that error appears in the above-identified patent and that said Letters Patent is hereby corrected as shown below:

In column 7, line 16, in Claim 1, delete “least” and insert -- at least --, therefor.

Signed and Sealed this
Twenty-fifth Day of September, 2012

David J. Kappos

David J. Kappos
*Director of the United States Patent and Trademark Office*